United States Patent [19]

McInnes

[11] Patent Number: 4,521,288

[45] Date of Patent: Jun. 4, 1985

[54] CATHODE STRUCTURE FOR CLEANING, PLATING AND/OR COATING APPARATUS

[76] Inventor: Robert McInnes, 4444 W. Bristol Rd., Flint, Mich. 48507

[21] Appl. No.: 614,134

[22] Filed: May 5, 1984

Related U.S. Application Data

[63] Continuation-in-part of Ser. No. 600,795, Apr. 6, 1984.

[51] Int. Cl.[3] ..... C25D 17/20

[52] U.S. Cl. ..... 204/213

[58] Field of Search ..... 204/213

[56] References Cited

U.S. PATENT DOCUMENTS

| | | | |
|---|---|---|---|
| 3,663,410 | 5/1972 | Schumacher | 204/213 |
| 3,855,107 | 12/1974 | McInnes | 204/213 |
| 3,944,189 | 3/1976 | Singleton | 204/213 |
| 4,305,804 | 12/1981 | Tipton | 204/213 |
| 4,390,399 | 6/1983 | McInnes | 204/213 |

FOREIGN PATENT DOCUMENTS

| | | | |
|---|---|---|---|
| 1808807 | 3/1970 | Fed. Rep. of Germany | 204/213 |

*Primary Examiner*—Thomas Tufariello

*Attorney, Agent, or Firm*—Barnes, Kisselle, Raisch, Choate, Whittemore & Hulbert

[57] ABSTRACT

Apparatus for cleaning, plating and/or coating articles comprising a container adapted to contain a liquid cleaning, plating or coating material. A barrel is at least partially submerged in the container and supported for rotation about its longitudinal axis. Laterally spaced stationary end walls are mounted in fixed position covering the ends of the barrel. A novel cathode structure is mounted on each end wall. The cathode structure comprises a cathode carried by a mounting block fixedly secured on the inner side of at least one of the end walls. One or more cable connectors on the outside of the end wall are provided, each having a contact portion extending through the end wall and abutting a contact plate which in turn is held in contact with the cathode.

6 Claims, 5 Drawing Figures

CATHODE STRUCTURE FOR CLEANING, PLATING AND/OR COATING APPARATUS

REFERENCE TO RELATED APPLICATION

This application is a continuation-in-part of my prior copending application, Ser. No. 600,795 filed Apr. 6, 1984.

This invention relates generally to apparatus for cleaning, plating and/or coating articles, and refers more particularly to cathode structure for such apparatus.

BACKGROUND OF THE INVENTION

In apparatus for cleaning, plating and/or coating articles of the type involved in this invention, a plurality of tank assemblies are provided through which articles to be processed are moved in sequence. Each tank assembly comprises a tank containing a cleaning, plating or coating liquid. A barrel is at least partially submerged in the liquid in each tank and is rotated about its longitudinal axis. The barrel has baffles on the interior thereof. When the barrel is rotated in one direction, the articles are agitated through the liquid, and when the barrel is rotated in the opposite direction, the articles are elevated and deposited on a chute for transfer to the next succeeding tank assembly.

It is an object of this invention to provide an improved cathode structure for those barrels which require electric current to carry out their processing function on the articles therein.

In apparatus presently in use, cathode danglers inside the plating barrel are employed. In order to increase the amperage, it is necessary to add more danglers. The danglers, of course, take up space and for that reason there is a practical limit to the number of danglers that can be used. In accordance with the present invention, the ends of the barrel are closed by stationary end walls, and a cathode is fixed to at least one stationary end wall. To increase the amperage, the cathode, which may be an elongated bar-like member, can simply be replaced by a longer cathode and more electrical cables can be employed to supply electrical energy. The cathode takes up only a minimum of interior space and the amount of amperage that can be delivered is practically unlimited. This is important because increased amperage permits higher rates of production.

SUMMARY OF THE INVENTION

In accordance with this invention, the apparatus comprises a container adapted to contain a suitable treating liquid. A barrel is at least partially submerged in the container and supported for rotation about its longitudinal axis.

The barrel has end openings. Stationary end walls fit within and close the end openings. A cathode is carried by a mounting block fixedly secured on the inner side of at least one of the end walls. A cathode contact plate is set in a recess in the mounting block in surface-to-surface electrical contact with the cathode. One or more cable connectors on the outside of the end wall are adapted to be connected to electrical cables. Each connector has a contact portion extending through the end wall and abutting the contact plate.

Preferably a second cathode is mounted in a similar manner on the other end wall and supplied with current from one or more additional electrical cables.

DETAILED DESCRIPTION

Figure 1:
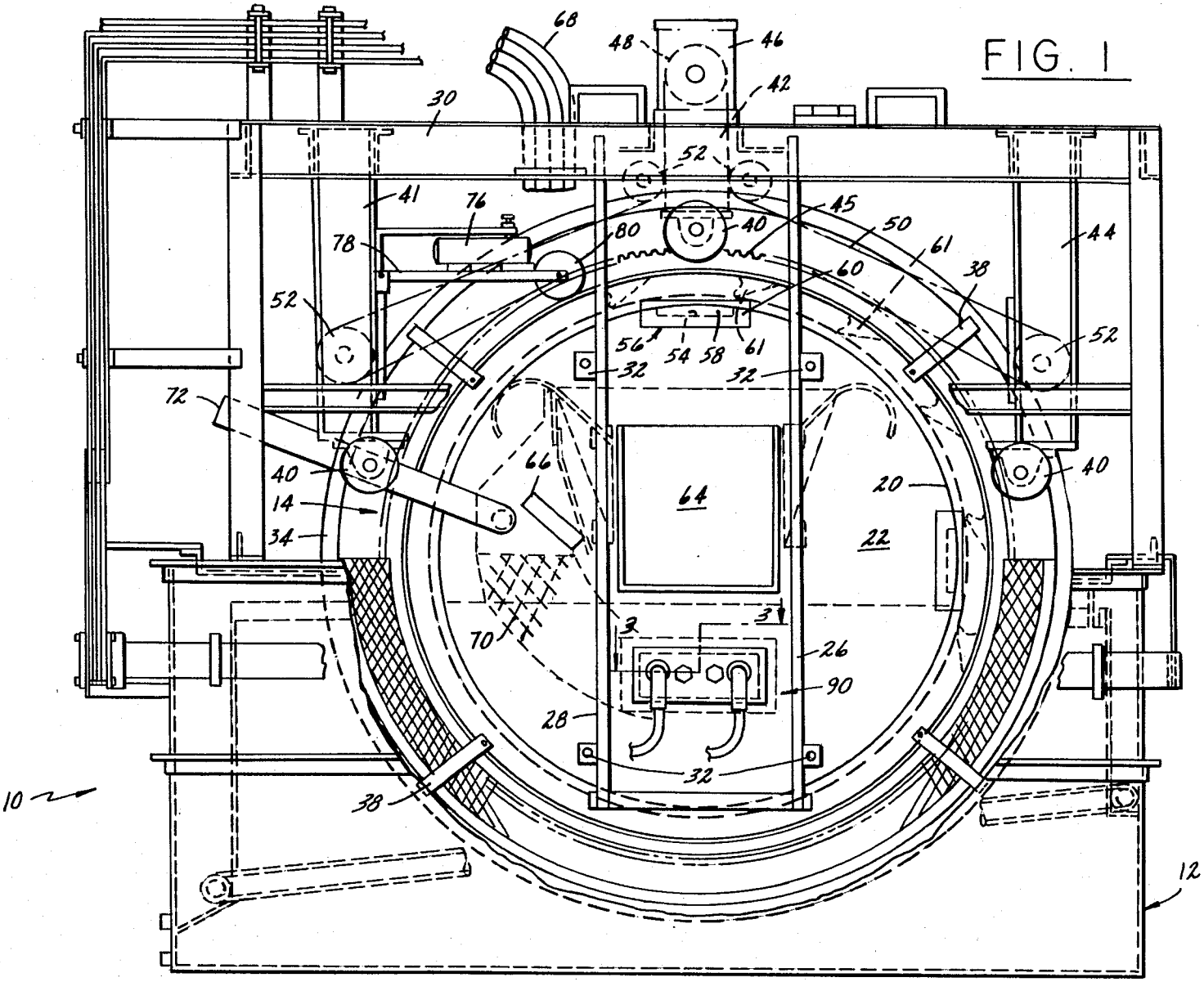
FIG. 1 is an elevational view of apparatus contructed in accordance with my invention, with certain details of the barrel, barrel mounting structure and stationary end wall omitted for clarity.
Figure 2:
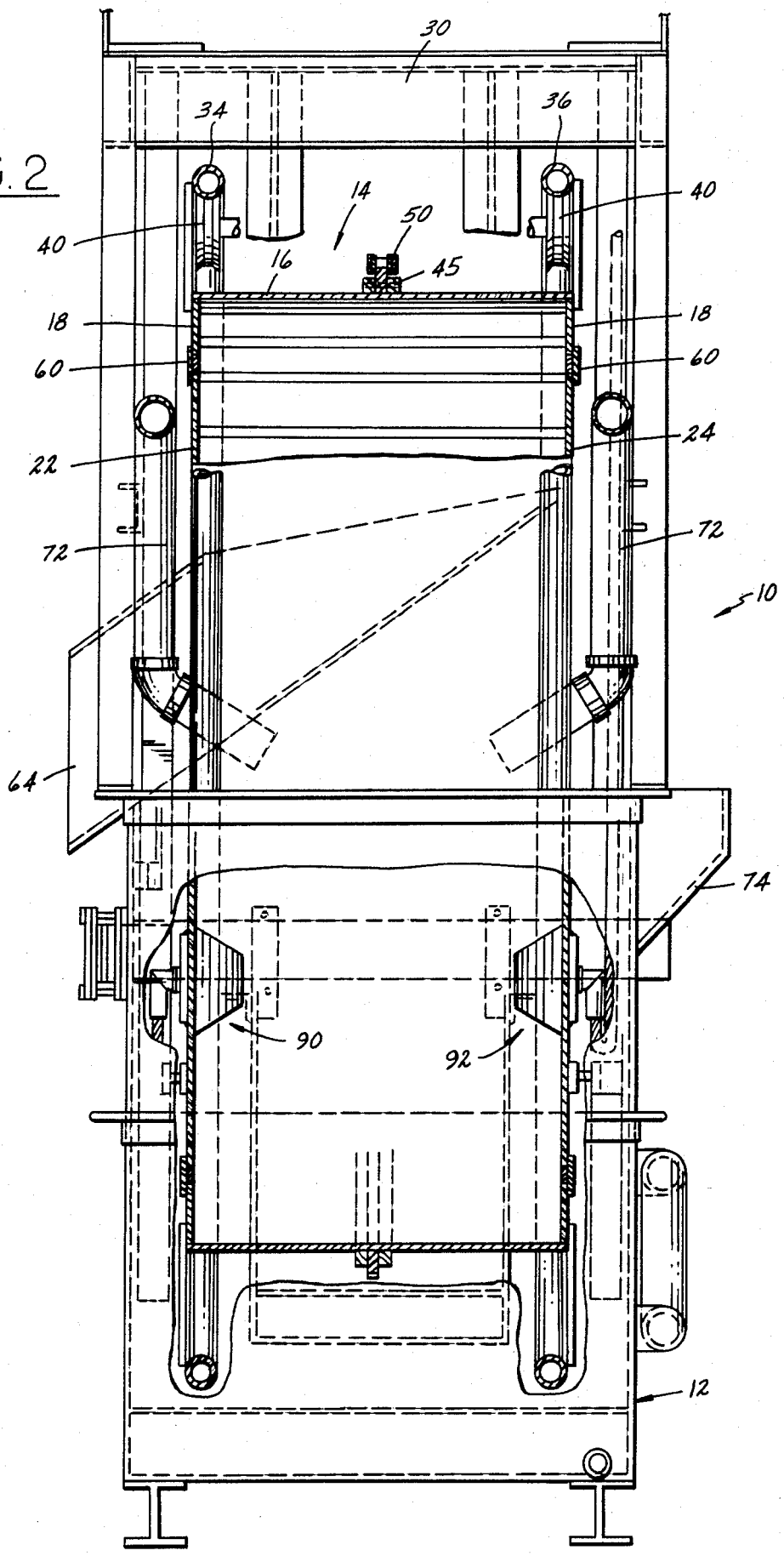
FIG. 2 is a view as seen from the right in FIG. 1, with parts broken away and in section.

The apparatus of this invention can be used for the cleaning, plating, or coating of articles.

The apparatus shown in the drawings is used in connection with the zinc plating of articles, but it should be understood that it can be adapted to other types of plating. The articles to be plated are fed from a metering hopper periodically in a batch to a first tank assembly. After treatment in the first tank assembly, the articles are fed to a second tank assembly, and so on to successive tank assemblies in order. By this arrangement, each tank assembly performs a function on a batch of articles while the other tank assemblies are performing their functions on other batches of the articles.

One such tank assembly is described herein in detail in which plating is carried out and accordingly electric power and a supply of plating material, in this instance zinc balls, are required. Other tank assemblies in the series carry out other functions such as cleaning or rinsing and do not require a supply of plating material and may or may not require electric power, but otherwise may be like the tank assembly described.

Referring now more particularly to the drawings, the tank assembly 10 includes a container 12 which is adapted to hold a treating or plating liquid, in this instance plating liquid. The tank assembly 10 also includes a barrel 14 which is generally cylindrical and has a cylindrical outer wall 16. At the ends of the cylindrical wall 16 are radially inwardly extending walls 18 which define concentric circular end openings 20.

Laterally spaced stationary end walls 22 and 24 cover the ends of the barrel. The end walls 22 and 24 are circular and are formed to fit within the end openings 20. The end walls are rigidly secured to frame elements 26 and 28 of the main frame 30 by brackets 32.

The barrel is mounted for rotation on the main frame 30 and, to this end, the barrel is provided with a pair of laterally spaced rings 34, 36 which incircle the barrel in concentric relation therewith and are rigidly secured to the barrel by radial attaching elements 38. A plurality of rollers 40 are mounted for free rotation on frame elements 41, 42 and 44 of the main frame 30 in arcuately spaced relation. The rings 34, 36 are suspended on the rollers. The rollers are located in positions spaced above the liquid in the container and support the barrel so that its lower portion is submerged in the liquid in the container.

The barrel is adapted to be rotated in one direction or the other about its longitudinal axis by means including reversible motor 46 mounted on the main frame. The output sprocket 48 of the motor drives a chain 50 which is trained over idler sprockets 52 on the frame elements 41, 42 and 44 of the main frame and engages the teeth of sprocket or gear 45 extending about the outer periphery of the cylindrical wall 16 of the barrel. The barrel is thus driven in rotation in one direction or the other depending upon the direction of rotation of the motor 46.

As previously stated, the end walls 22, 24 fit within the end openings 20 of the barrel. The circular peripheries of the end walls are notched at spaced points where indicated at 54. Retainers 56 are provided at these spaced points, each retainer having a mounting portion 58 fitted within a notch and a retaining portion 60 projecting radially outwardly from the periphery of the end wall upon which it is mounted. The retaining portions 60 overlap the radial walls 18 of the barrel and retain the barrel axially. The barrel is capable of free rotation with respect to the stationary end walls. The barrel including the end walls are made of a suitable plastic material such as polypropylene and are formed with a plurality of holes for the free passage of treating liquid into the barrel.

The barrel has a plurality of circumferentially spaced axially extending baffles 61 on the inner surface of its cyclindrical wall 16 which extend radially inwardly and form an acute angle with the inner periphery such that when the barrel is rotated clockwise in FIG. 1 the articles are agitated and when the barrel is rotated counter-clockwise the baffles elevate the articles and cause them to drop. For a more complete description of the baffles and the manner in which they function during the rotation of the barrel in one direction or the other, attention is called to my prior U.S. Pat. Nos. 3,855,107, 3,926,666 and 4,390,399 the disclosures of which are incorporated herein by reference.

An elongated chute 64 is provided for the barrel extending through an opening in the end wall 22. The chute extends from the interior of the barrel adjacent the end wall 24 through the end wall 22 to its discharge end adjacent the inlet in the wall of the barrel in an adjacent assembly, not shown.

The end walls also have openings 66 through which extend the electrical cables 68 to the anode 70 within the barrel. The anode is in the form of a basket suspended from the chute. The anode basket 70 is adapted to contain plating elements, in this instance zinc balls, which may be fed to the basket from the outside by means of conduits 72 extending through suitable openings in the end walls.

The end wall 24 has an inlet 74 through which articles may be introduced into the barrel.

An eccentric vibrator 76 is provided for the barrel, mounted on the frame member 41. The vibrator contacts the flexible arm 78 which arm is connected at one end to the frame member 41 and has a roller 80 on the other end engaging the cylindrical outer wall 16 of the barrel. The barrel is not vibrated during processing of articles when the barrel is rotated clockwise in FIG. 1, but is vibrated during reverse rotation in the counter-clockwise direction so that articles will not stick to the barrel but will drop into the chute for transfer.

An eccentric vibrator, not shown, may also be provided for the chute. When operated, the vibrator causes the chute to vibrate, thereby facilitating the transfer of articles along the chute to the next barrel in the series. The chute vibrator is not operated during processing when the barrel is rotated clockwise in FIG. 1, but is operated only when the barrel is rotated counter-clockwise for the transfer of articles to the next barrel.

A cathode structure 90 is shown mounted on one of the end walls 22 and a like cathode structure 92 is mounted on the other end wall 24. These cathode structures are identical in every detail and hence a description of one will suffice for both.

Figure 3:
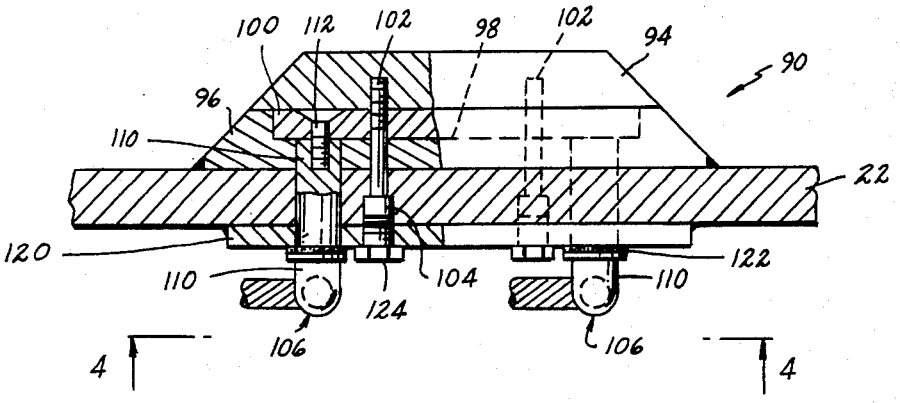
FIG. 3 is a sectional view taken on the line 3—3 in FIG. 1.
Figure 4:
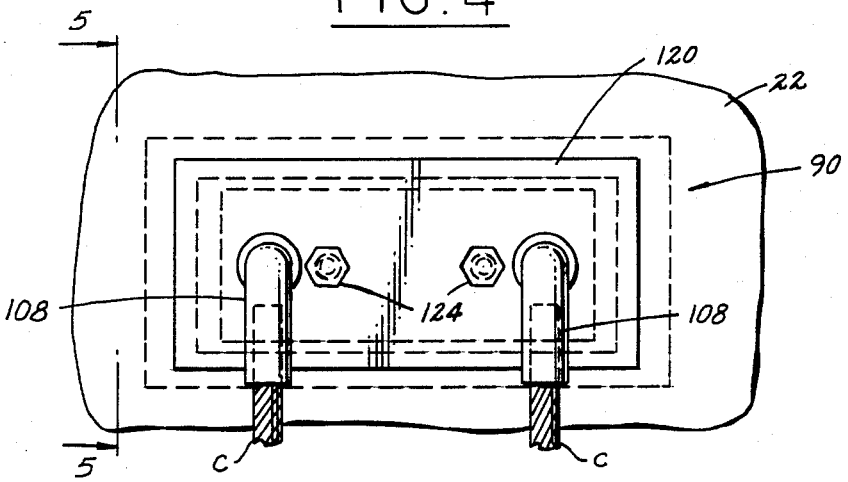
FIG. 4 is a view taken on the line 4—4 in FIG. 3.
Figure 5:
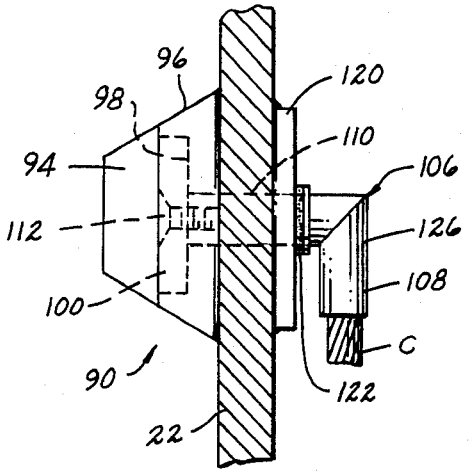
FIG. 5 is a sectional view taken on the line 5—5 in FIG. 4.

Referring to FIGS. 3–5, the cathode structure 90 mounted on the end wall 22 comprises a elongated metal plate or bar-like cathode 94 of electrically conducting material. The cathode 94 is mounted within the barrel on the inner face of an elongated mounting block 96 secured to the inner side of the end wall 22 by any suitable means as by welding. The mounting block is preferably made of polypropylene or any other suitable non-conducting material and has a recess 98 in its inner face. A cathode contact plate 100 of electrically conducting material is set in the recess. Electrically conducting metal bolts 102, the heads of which are disposed in sockets 104 in the end wall, extend through the end wall, the mounting block 96 and the contact plate 100 and thread into the cathode 94. By tightening the bolts 102, the cathode 94 is held in full surface-to-surface electrical contact with the contact plate 100.

Electrical connectors 106 of L-shaped configuration are provided, which are formed of an electrically conducting metal. The connectors each have one hollow leg 108 in which a cable C is received, and one solid leg 110 which extends through a hole in the end wall and in the mounting block and abuts in electrical contact with the contact plate 100. Screws 112 are provided for removably securing the connectors 106 to the contact plate 100, threading into the solid leg contact portions 110 of the connectors.

A backing plate 120 of plastic or other suitable non-conducting material extends over the outer surface of the end wall, having suitable openings which clear the solid leg contact portions 110 of the connectors and which register with the sockets 104 in the end wall. A gasket 122 of non-conducting material surrounds the solid leg portion of each connector. Caps 124 of nylon or other suitable non-conducting material are threaded into the holes of the backing plate 120 to isolate the heads of bolts 102.

An insulating sleeve 126 of rubber or the like covers the portions of each connector which are exposed on the outer side of the end wall. The insulating sleeves 126, backing plate 120, gaskets 122 and caps 124 provide a complete insulation for the portions of the cathode structure on the outer side of the end wall.

The cathode 94 can be replaced by loosening and removing the bolts 102. The heads of the bolts 102 are accessible from the outside when caps 124 are removed. After the cathode 94 is removed, the heads of screws 112 are, of course, accessible.

As previously stated, in conventional plating apparatus presently in use, cathode danglers inside the plating barrel are employed, and in order to increase the amperage it is necessary to add more danglers. However, because the danglers take up space, there is a practical limit to the number of danglers that can be added. Accordingly, conventional plating apparatus cannot operate at more than about 1000 amperes. Because the cathode structure of the present invention takes up only a very minimum of interior space, the amount of amperage is almost unlimited. In the present embodiment, about 1000 amperes per cable can be delivered, for a total of 4000 amperes, 2000 amperes through each end wall. Cables can be added by using longer cathodes.

In operation, a batch of articles is loaded into the barrel 14 through the inlet 74 either from a loading hopper or from the chute of an adjacent barrel. The barrel is rotated clockwise in FIG. 1 by motor 46 to agitate the articles. At the same time the articles are being processed in barrel 14, other batches of articles are being processed in other barrels in the series.

At the conclusion of the plating process in barrel 14, the drive motor 46 is reversed to rotate the barrel in the opposite direction, counter-clockwise in FIG. 1, causing the baffles to elevate the articles and drop them into the chute. During the counter rotation of the barrel 14, the barrel and the chute are vibrated, the vibration of the barrel preventing articles from adhering to the cylindrical surface of the barrel 14 and the vibration of the chute facilitating the sliding transfer of articles through the chute into the next barrel.

I claim:

1. In an apparatus for cleaning, plating and/or coating articles, the combination comprising:

a container adapted to contain a liquid treatment material, a barrel adapted to be at least partially submerged in liquid in said container, said barrel having a longitudinal axis, means for rotatably supporting said barrel so that it is partially submerged in liquid in said container, said barrel having a central opening in one end thereof, an end wall mounted in fixed position covering the central opening in said one end of said barrel, cathode structure comprising a cathode, means fixedly mounting said cathode on the inner side of said end wall, and a cable connector on the outer side of said end wall to which an electrical cable is adapted to be connected and having means forming an electrical connection with said cathode.

2. The apparatus set forth in claim 1, wherein said mounting means comprises a mounting block secured to the inner side of said end wall, a removable fastener extending through said end wall and said mounting block and threading into said cathode, said fastener being accessible from the outer side of said end wall to permit removal of said fastener and release of said cathode.

said fastener having a head disposed in a socket in said end wall, and removable means for covering said socket to electrically insulate said fastener head.

3. In an apparatus for cleaning, plating and/or coating articles, the combination comprising a container adapted to contain a liquid treatment material, a barrel adapted to be at least partially submerged in liquid in said container, said barrel having a longitudinal axis, means for rotatably supporting said barrel so that it is partially submerged in liquid in said container, said barrel having a central opening in one end thereof, an end wall mounted in fixed position covering the central opening in said one end of said barrel, cathode structure comprising a cathode, means fixedly mounting said cathode on the inner side of said end wall, and a cable connector on the outer side of said end wall to which an electrical cable is adapted to be connected and having means forming an electrical connection with said cathode, said mounting means comprising a mounting block secured to the inner side of said end wall and supporting a cathode contact plate, said cathode being mounted on said mounting block in electrical contact with said contact plate, said cable connector having a portion extending through said one end wall and abutting said contact plate to form the aforesaid electrical connection therewith.

4. The apparatus set forth in claim 3, wherein said cathode contact plate is set in a recess in said mounting block in surface-to-surface contact with said cathode, and means are provided for releasably securing said contact plate to said portion of said connector.

5. In an apparatus for cleaning, plating and/or coating articles, the combination comprising a container adapted to contain a liquid treatment material, a barrel adapted to be at least partially submerged in liquid in said container, said barrel having a longitudinal axis, means for rotatably supporting said barrel so that it is partially submerged in liquid in said container, said barrel having a plurality of circumferentially spaced baffles on the inner periphery thereof, said baffles extending radially inwardly and forming an acute angle with said inner periphery such that when said barrel is rotated in one direction, said baffles agitate the articles, and when said barrel is rotated in the opposite direction, said baffles elevate the articles and cause them to drop, said barrel having a central opening in each end thereof, laterally spaced stationary end walls mounted in fixed positions covering the central openings in the ends of said barrel, cathode structure comprising a cathode, means fixedly mounting said cathode on the inner side of one of said end walls, and a cable connector on the outer side of said one end wall to which an electrical cable is adapted to be connected and having means forming an electrical connection with said cathode, said mounting means comprising a mounting block secured to the inner side of said one end wall, a cathode contact plate set in a recess in said mounting block, said cathode being mounted on said mounting block in surface-to-surface electrical contact with said contact plate, said cable connector having a portion extending through said one end wall and said mounting block and abutting said contact plate to form the aforesaid electrical connection therewith, means for releasably securing said contact plate to said portion of said connector, and means providing an electrically insulating cover for the part of said connector which would otherwise be exposed on the outer side of said one end wall, and chute means extending from the interior of said barrel through an opening in one of said end walls such as to receive articles dropped by the baffles by gravity and discharge them from the barrel.

6. The apparatus set forth in claim 5, wherein removable fasteners are provided which extend through said one end wall, said mounting block and said contact plate and thread into said cathode, said fasteners having heads disposed in sockets in the outer side of said one end wall, means for electrically insulating said fastener heads comprising a plate of electrically insulating material applied to the outer side of said one end wall and having openings registering with said sockets, and caps of electrically insulating material closing said openings, said caps being removable to permit access to said fastener heads from the outer side of said one end wall so that said fasteners can be removed and said cathode released.

* * * * *